United States Patent [19]

Ichihara et al.

[11] Patent Number: 4,703,401

[45] Date of Patent: Oct. 27, 1987

[54] HEAD LAMP FOR AUTOMOBILES

[75] Inventors: Takeo Ichihara, Hatano; Shuichi Watanabe, Yamato; Takashi Futami, Tokyo; Nobutaka Oda, Yokohama, all of Japan

[73] Assignee: Stanley Electric Co., Ltd., Tokyo, Japan

[21] Appl. No.: 940,542

[22] Filed: Dec. 11, 1986

[30] Foreign Application Priority Data

Dec. 23, 1985 [JP] Japan ..... 60-197924[U]

[51] Int. Cl.[4] ..... F21V 7/20

[52] U.S. Cl. ..... 362/80; 362/346; 362/345; 362/294; 313/113

[58] Field of Search ..... 362/61, 80, 297, 267, 362/296, 346, 345, 294; 313/113, 114

[56] References Cited

U.S. PATENT DOCUMENTS

| | | | |
|---|---|---|---|
| 4,336,578 | 6/1982 | Bradley et al. | 362/267 |
| 4,555,748 | 11/1985 | Bradley | 313/113 |
| 4,563,730 | 1/1986 | Saito | 362/80 |

FOREIGN PATENT DOCUMENTS

| | | | |
|---|---|---|---|
| 2022234 | 12/1979 | United Kingdom | 362/61 |
| 2069123 | 8/1981 | United Kingdom | 362/346 |

*Primary Examiner*—William A. Cuchlinski, Jr.
*Assistant Examiner*—D. M. Cox
*Attorney, Agent, or Firm*—Frishauf, Holtz, Goodman & Woodward

[57] ABSTRACT

In an automotive head lamp, an auxiliary reflector made of heat-resisting synthetic resin is integrally provided in the center portion of a reflector made of synthetic resin. The heat-resistant auxiliary reflector encircles the bulb.

12 Claims, 3 Drawing Figures

HEAD LAMP FOR AUTOMOBILES

BACKGROUND OF THE INVENTION

This invention relates to a head lamp for automobiles.

In a head lamp for an automobile, it is necessary to mold a reflector and a lens from synthetic resins in order to reduce their weight. When the reflector is molded from a synthetic resin, sink marks disadvantageously appear. Particularly, in the case where a waterproof visor wall is projectingly provided on the back of the reflector, a sink mark is produced in the inner wall of the reflector at the root portion thereof, thus deteriorating the reflecting function of the reflector. Further, a reflector made of synthetic resin encounters a problem due to the high temperature of the bulb. If the reflector is formed of heat-resistant resin in order to overcome this problem, the weight increases, which runs counter to the desirability of reducing the weight.

The problems intended to be solved by the present invention relate to the sink marks and the heat resistance of the reflector made of synthetic resin. It is an object of the present invention to overcome the deterioration of the reflecting function caused by the sink marks and the increase in weight caused by the heat-resisting resin.

For solving the aforementioned problems to achieve the intended object, according to the present invention, an auxiliary reflector made of heat-resisting synthetic resin is integrally provided in a center portion encircling a bulb of a main reflector made of synthetic resin.

DETAILED DESCRIPTION OF THE INVENTION

Figure 1:
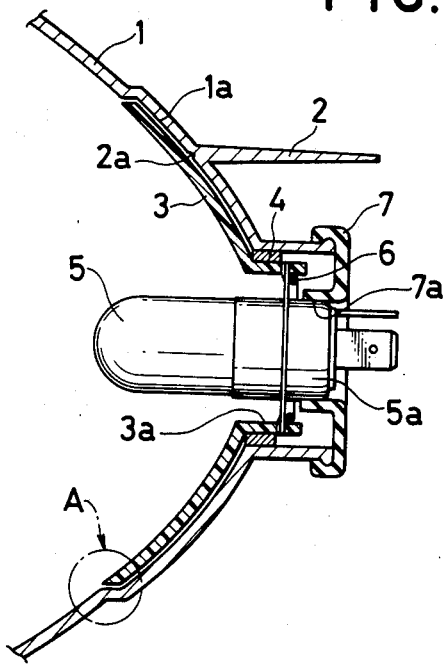
FIG. 1 is a sectional view of essential parts showing one embodiment according to the present invention.
Figure 2:
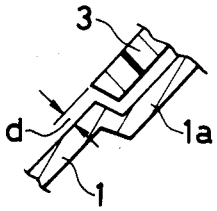
FIG. 2 is an enlarged view of a portion designated A of FIG. 1.
Figure 3:
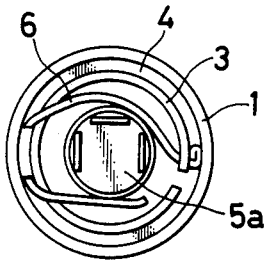
FIG. 3 is a rear elevation of bulb mounting portion.

Referring to FIG. 1, a main reflector 1 made of synthetic resin has a depressed portion 1*a* formed in the center portion encircling a bulb and a waterproof visor wall 2 projected rearwardly thereof. An auxiliary reflector 3 made of a heat-resisting synthetic resin is fitted into the depressed portion 1a of the main reflector 1 and is integrated therewith through a joining portion 4 by insert molding. As seen in FIG. 2, difference d in level between the forward edge portion of the auxiliary reflector 3 and the depressed portion 1a is set so as not to be a negative value: that is, so that the auxiliary reflector 3 is not embedded into the depressed portion 1*a*. It is noted that the auxiliary reflector 3 may be connected to the main reflector 1 by, for example, tapped screws or the like. A bulb 5 is fixed to a bulb mounting portion 3*a* of the auxiliary reflector 3 through a support spring 6, as best seen in FIG. 3. A socket cover 7, which is fitted onto the rear end of the main reflector 1, has a central hole 7*a* into which a base 5*a* of the bulb 5 is inserted.

According to the automobile head lamp of the present invention, even if a sink mark 2*a* is produced at the root portion of the waterproof visor wall 2 in the main reflector 1, this sink mark is hidden or covered by the auxiliary reflector 3. Therefore, the reflecting function thereof is not deteriorated as in the prior art. Moreover, an auxiliary reflector 3 excellent in heat resistance is mounted on the central portion which is liable to be exposed to high heat from the bulb 5. Therefore, a bulb 5 of high wattage may be used. Moreover, since the high heat problem has been solved, the head lamp may be miniaturized.

As described above, according to the present invention, a heat-resisting auxiliary reflector is integrally provided in the center portion of a main reflector made of synthetic resin, and therefore, a sink mark in the waterproof visor wall or the like is hidden or covered by the auxiliary reflector to prevent a lowering of the reflecting function caused by the sink mark. In addition, since the whole reflector is not molded from heat-resisting synthetic resin, the weight can be prevented from increasing and the cost is low. Furthermore, if the whole reflector is molded from heat-resisting resin, as in the prior art, a lens made of resin cannot be directly connected to the reflector by deposition or the like. But, according to the present invention, this can be accomplished, which is advantageous in assembling work.

What is claimed is:

1. A head lamp for an automobile, comprising:

a main reflector made of a synthetic resin;

a bulb mounted substantially at the center of said main reflector;

an auxiliary reflector integrally connected to said main reflector and arranged in the center portion of said main reflector and encircling said bulb;

said auxiliary reflector being smaller than said main reflector and being made of heat-resisting synthetic resin which is more heat-resisting than the resin from which said main reflector is made.

2. A head lamp of claim 1, wherein said main reflector has a depression therein, said auxiliary reflector being mounted in said depression.

3. The head lamp of claim 2, wherein said auxiliary reflector has a thickness which is greater than the depth of said depression.

4. The head lamp of claim 2, wherein said depression is in said center portion of said main reflector.

5. The head lamp of claim 1, wherein said main reflector has a member integrally formed therewith and extending rearwardly therefrom, said member producing a sink mark in the front surface of said main reflector in said center portion of said main reflector, said auxiliary reflector covering said sink mark to prevent deterioration of the reflecting function of said head lamp.

6. The head lamp of claim 5, wherein said main reflector has a depression therein, said auxiliary reflector being mounted in said depression.

7. The head lamp of claim 6, wherein said auxiliary reflector has a thickness which is greater than the depth of said depression.

8. The head lamp of claim 6, wherein said depression is in said center portion of said main reflector.

9. A head lamp for an automobile, comprising:

a main reflector made of a synthetic resin;

a bulb mounted substantially at the center of said main reflector;

an auxiliary reflector integrally connected to said main reflector and arranged in the center portion of said main reflector and encircling said bulb;

said auxiliary reflector being smaller than said main reflector and being made of heat-resisting synthetic resin; and said main reflector having a member integrally formed therewith and extending rearwardly therefrom, said member producing a sink mark in the front surface of said main reflector in said center portion of said main reflector, said auxiliary reflector covering said sink mark to prevent deterioration of the reflecting function of said head lamp.

10. The head lamp of claim 9, wherein said main reflector has a depression therein, said auxiliary reflector being mounted in said depression.

11. The head lamp of claim 10, wherein said auxiliary reflector has a thickness which is greater than the depth of said depression.

12. The head lamp of claim 10, wherein said depression is in said center portion of said main reflector.

* * * * *